United States Patent [19]

Williams

[11] Patent Number: 4,641,788

[45] Date of Patent: Feb. 10, 1987

[54] METHOD OF SIMULTANEOUSLY GRINDING COAL AND DOLOMITE

[75] Inventor: Robert M. Williams, Ladue, Mo.

[73] Assignee: Williams Patent Crusher and Pulverizer Company, St. Louis, Mo.

[21] Appl. No.: 672,067

[22] Filed: Nov. 16, 1984

Related U.S. Application Data

[62] Division of Ser. No. 449,438, Dec. 13, 1982, abandoned.

[51] Int. Cl.[4] ..... B02C 19/12

[52] U.S. Cl. ..... 241/14; 241/24; 241/27

[58] Field of Search ..... 241/5, 10, 12, 14, 24, 241/26, 27

[56] References Cited

U.S. PATENT DOCUMENTS

| | | | |
|---|---|---|---|
| 1,753,437 | 4/1930 | Lykken | 241/5 |
| 1,838,560 | 12/1931 | Lykken | 241/5 |
| 3,834,631 | 9/1974 | King | 241/26 |

*Primary Examiner*—Howard N. Goldberg
*Assistant Examiner*—Joseph M. Gorski
*Attorney, Agent, or Firm*—Gravely, Lieder & Woodruff

[57] ABSTRACT

Apparatus for simultaneously grinding coal and dolomite to a size suitable for fluid bed combustors in which the grinding mill is modified to allow for the formation in the mill of a bed of the mixed coal and dolomite which reduces the tendency of dolomite to fracture and produce excess of fine particles thereby optimizing the grinding conditions for both coal and dolomite, and a method of reducing coal and dolomite simultaneously in a common mill and in predetermined proportions for optimum reduction of each material.

9 Claims, 1 Drawing Figure

METHOD OF SIMULTANEOUSLY GRINDING COAL AND DOLOMITE

This application is a division of application Ser. No. 449,438 filed Dec. 13, 1982 now abandoned.

BACKGROUND OF THE INVENTION

1. Field of the Invention

This invention relates to the method of simultaneous grinding of coal and dolomite in preparation for injecting the mix into a combustion chamber, and apparatus for accomplishing the method.

2. Description of the Prior Art

The development of atmospheric fluidized bed combustion requires an absorbent for the sulphur dioxide, such as the addition of dolomite to the coal to minimize sulphur emissions, as the dolomite reacts with the sulphur in the coal during combustion. Dolomite is a mineral of carbonate of calcium and magnesium, and when mixed with coal in a combustion environment chemically reacts with the sulphur in coal to greatly reduce the sulphur emission. In the grinding of dolomite it fractures and produces a large amount of fine particles of the order of minus 140 mesh when grinding is set for producing minus one-eighth size which is 6 mesh.

The use of coal in atmospheric fluidized bed combustion needs to be carried out with control over the sulphur dioxide emission. This control is accomplished with dolomite to produce the calcium to sulphur (CA:S) mole ratio for removal of a high percentage of sulphur dioxide. Particle size is important to utilize the absorption reaction from dolomite. If the particles are too fine the fluidizing thereof will carry them through the bed. The problem is to get a proper particle size when grinding the dolomite.

Since coal and dolomite grind differently, it has been the practice to grind each separately and to thereafter mix them in the desired proportions. If the setting for grinding coal is used for grinding dolomite it results in shattering the dolomite into a too fine state, and when coal is processed at a dolomite setting it is too coarse. As an example, the crushing hardness and density of coal and dolomite varies greatly, as for example: coal grinding yields about 99.8% particles of 6 mesh, 13.3% minus 140 mesh, a density of 45.6 pounds per cubic foot, at about 0.1% surface moisture. The dolomite yields about 97.8% particles of 6 mesh, 20.1% minus 140 mesh, a density of 109.7 pounds per cubic foot, at about 0.3% surface moisture, but at a substantially different air setting.

The separate grinding circuits include a separate crushing system for coal and dolomite. It also requires separate collecting bins, and a mixing circuit with necessary conveyors and a separate bin for the mixed product.

An example of grinding coarse and fine material in a common mill is found in Hardinge U.S. Pat. No. 2,381,351 of Aug. 7, 1945, the system of this disclosure being limited to separating a single type of material into coarse and fine portions and controlling the quantity of each portion allowed to enter the mill where the collecting of the coarse material is used to effect the grinding and crushing of the total content of the mill.

The presence of particulate grindings of minus 140 mesh presents problems in pressurized fluid bed combustors. The injectors used to inject the mixture of two parts of coal and one part of dolomite have a tendency to plug with the excess minus 140 mesh particulate matter. After injection into the pressurized fluid bed combustor the minus 140 mesh particulate matter has a tendency to pass directly through the combustion zone resulting in a loss of carbon. It has already been pointed out above that there is the additional problem of drying, grinding, sizing, storing, and mixing the dried coal and dolomite when prepared as separate products prior to injection.

BRIEF DESCRIPTION OF THE INVENTION

In order to overcome the various problems which have been pointed out above, the present invention is directed to a method of simultaneously delivering coal and dolomite in proportions of two parts of coal to one part of dolomite to a grinding mill where the grinding and mixing takes place so as to avoid the need for separate provisions for grinding coal and dolomite individually. The method is performed in an impact hammer mill by changing the bottom clearance below the path of hammers so as to allow for the formation of a bed of material below the path of the hammers thereby reducing the tendency of the dolomite to fracture and produce the excess of minus 140 mesh particles. It has been found that by simultaneously feeding and grinding two parts of coal and one part of dolomite, the product yield of coal and dolomite has resulted in a mix thereof containing 99.8% of 6 mesh, 17.2% of 140 mesh, at a density of about 109.7 pounds per cubic foot, and with a surface moisture content of about 0.1%.

One of the objects of the present invention is to modify an impact mill by changing the bottom clearances below the impact hammers to allow for the formation of a bed of material in position to optimize the crushing conditions by creating a "softer" bed of coal mix so as to absorb the impact energy required to grind the harder and denser dolomite without over pulverizing it.

An important object of the present invention is to mix coal and dolomite in a predetermined proportion and deliver the mix to be ground simultaneously while retaining a portion of the mixed material in position to absorb the impact of the grinding imparted to the mixed material for limiting the amount of the mixed material reduced to fines.

The present improvement overcomes the problem of finding a setting in the impact mill which would be a compromise between the setting for grinding dolomite separately and grinding coal separately. When the mill setting is set for dolomite and is used to grind coal the result is a high percentage of coarse coal product which is unacceptable. If the setting is reversed, then the dolomite product contains an excessive fine of the order of minus 140 mesh product which reaches about 35.6%, and that has been found to be unacceptable.

The apparatus for practicing the presently improved method of simultaneously grinding coal and dolomite comprises providing a common impact mill with a modified clearance in the grinding chamber to allow the formation of a soft material bed so as to minimize the creation of minus 140 mesh product, whereby the impact mill produces a mix in the ratio of approximately two parts of coal to one part of dolomite to be transported by a suitable conveying system for injection into a pressurized fluid bed combustor.

BRIEF DESCRIPTION OF THE DRAWING

The present invention is illustrated in a single schematic view of apparatus presently preferred to practice the method.

DETAILED DESCRIPTION OF THE EMBODIMENT

Figure 1:
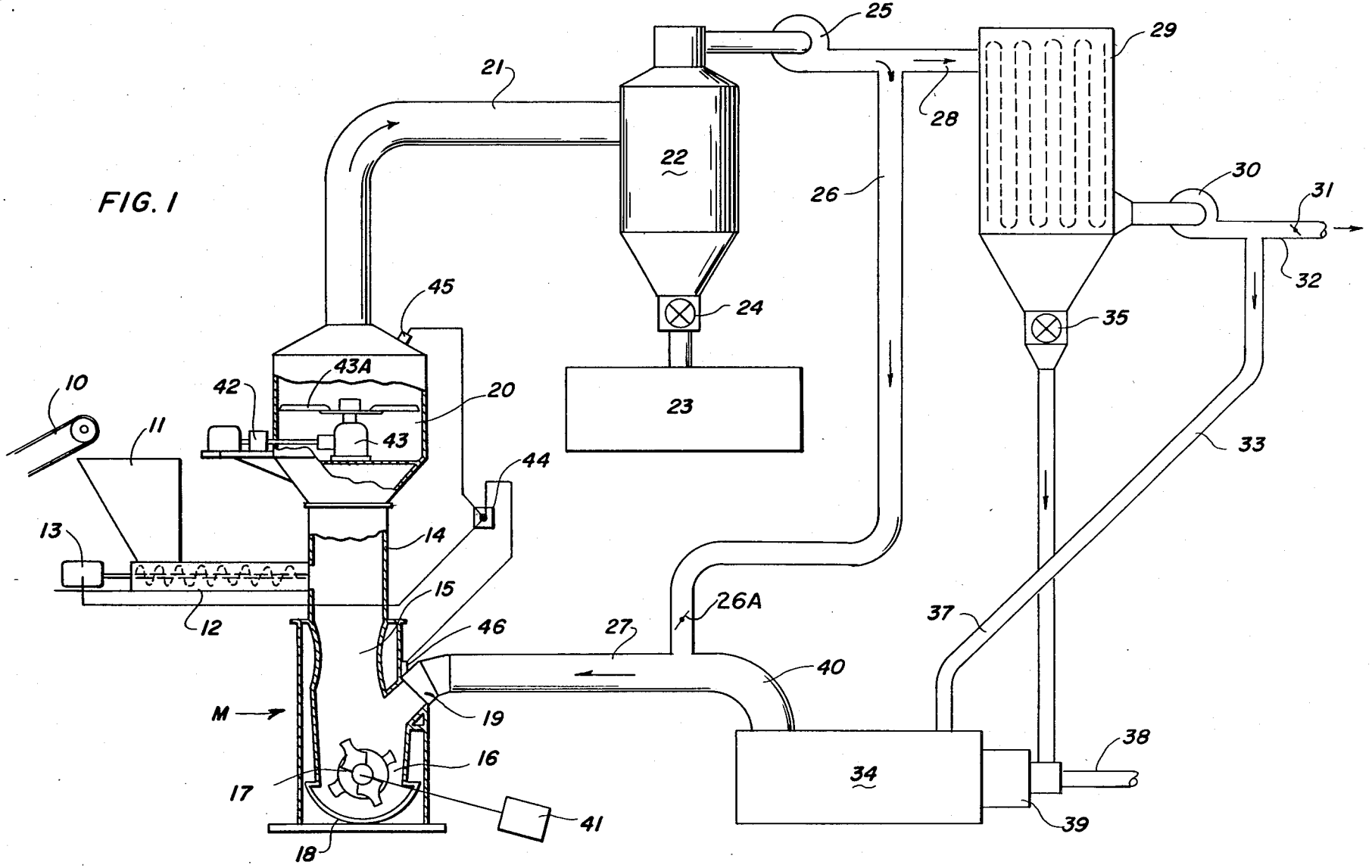

The practice of the method of this invention is carried out in apparatus shown in the schematic drawing which comprise a conveyor 10 for delivering a mix of approximately two parts of coal to one part of dolomite into a hopper 11 where it is simultaneously propelled and mixed by a screw conveyor 12, driven by a motor 13 into a vertical column 14 above a venturi throat 15. While a screw conveyor is shown, other conveying and mixing means can be employed. The mixed material falls by gravity through the throat 15 into an impact mill M in which there is a grinding chamber 16 formed therein for the impact rotor 17. The grinding chamber 16 is provided with a bottom clearance space or cavity 18 below the travel of the impact hammers of the rotor 17 so as to permit the accumulation of coal and dolomite to form a "soft" bed for absorbing the impact energy imparted to the coal and dolomite thereby helping to limit the grinding of the dolomite to a minimum of minus 140 mesh particles. The product produced by the impact rotor 17 is conveyed upwardly through the venturi throat 15 by the flow of air which is introduced at the inlet 19 located so as to direct the air flow into the grinding chamber 16 for lifting the product upwardly through the venturi throat 15 and into a spinner separator 20 where overly large particles in the product can be separated and returned to the grinding chamber 16 for further reduction.

The product passing through the spinner separator 20 is conducted by a conduit 21 to a cyclone separator 22, and from the separator 22 it is collected in a bin 23 when discharged through rotary valve 24. The transport air or gaseous medium leave the cyclone separator 22 by the suction of blower 25 and follows two courses. One course is defined by a conduit 26, having flow proportioning damper 26A, directing the gaseous medium into a conduit 27 which is connected to the inlet 19 opening into the grinding chamber 16 at the mill M. The second course for the gaseous medium moved by the blower 25 is through a branch conduit 28 and into a bag house 29 where the dust particles, which have a fineness of 140 mesh as previously noted are captured and substantially clean air and moisture is removed by a blower 30 for discharge at outlet 32 to the atmosphere. A suitable flow valve 31 in the outlet 32 to atmosphere from blower 30 is controllable to proportion the amount of air that, instead of being lost to atmosphere, may be returned by a conduit 33 to a heater 34 to support combustion. Startup of the heater is carried out by an external source of either oil or gas fuel supplied by the conduit 38 into the burner 39. The heated gaseous medium from the heater 34 passes through the stack 40 and is returned by conduit 27 to inlet 19 at the grinding mill for the purpose of effecting drying of the material during its reduction in the mill M.

The fine particles collected in the bag house 29 are discharged through rotary valve 35 to conduit 38 which directs those particles into the burner 39 which supplies the heater 34 with the fuel values it may have to help raise the temperature of the air which is discharged through the heater stack 40 to enter into conduit 27 on its way to the mill inlet 19. In this way the heating value of the fines is not lost but contributes its energy to the drying process. At start-up, the heater 34 is supplied with an outside fuel which may be either oil or gas, or pulverized coal, depending on the availability and the character of the burner 39 that is being employed. The hot air flows into the grinding chamber 16 and not only dissipates the surface moisture in the material being ground therein, but also acts as the conveying medium for lifting the ground particles through the venturi throat 15 where the particles are subjected to the spinner separator 20 so that the coarse portion can be returned to the mill for further reduction. The flow through the venturi throat 15 acts to strip fines that are present in the incoming coal and dolomite and lift such fines into the separator 20 so it does not reach the mill. Since the material entering the mill is a mixture of coal and dolomite having different hardness characteristics, it has been pointed out above that the normal structure in the bottom of the mill crushing chamber 16 is modified to provide a cavity 18 below the rotor 17 so that coal and dolomite may be collected to form a soft cushion or body of the material so as to minimize the shattering of the harder dolomite material which thereby reduces the quantity of fines of the order of minus 140 mesh.

In order to coordinate the operation of the mill M and the spinner separator 20 in the desired manner, there is shown schematically a drive transmission 41 for the rotor 17 and a drive transmission 42 for the gear box 43 in the spinner separator 20. These transmissions are under control of control means 44 which receives a signal from a pressure sensor 45 in the head portion of the spinner separator 20, and a signal from a pressure sensor 46 in or adjacent the crushing chamber 16 in the mill M. The control 44 operates to maintain a substantially constant differential pressure between the crushing chamber 16 and the spinner separator 20 by controlling the motor means 13 to feed more or less coal so that the mill speed and separator speed do not have to be adjusted once the desired output is obtained. The difference in the pressure at the two zones should be desirably maintained at approximately 8 to 10 inches of water by control means 44.

The foregoing detailed description has set forth a method for simultaneously grinding coal and dolomite, and to apparatus for practicing that method. It should now appear that the method is directed to grinding in a common mill material having different hardness characteristics by first mixing the different materials before delivering the same into a grinding mill, while retaining a portion of the mixed material in the mill in a position to absorb the impact of the grinding performed on the mix of material, for thereby limiting the amount of the mixed material reduced to fines. The method also is directed to controlling the proportions of the different materials in a ratio where the softer material is in greater proportion than the harder material so that a "soft" cushion can be retained in position to absorb the energy of reduction imparted to the mix for minimizing the creation of extreme fines which would otherwise result from reduction of a harder material if processed alone.

The preferred apparatus for practicing the method comprises a rotary impact grinding mill adapted to receive a supply of material made up of components which vary in hardness characteristics, the provision of a cavity in the grinding mill positioned to accumulate a quantity of the material undergoing reduction to form a cushion in the grinding mill for minimizing reduction of the material to extreme fines, and gaseous medium supplied to the grinding mill for transporting the ground product as well as effecting a reduction of surface moisture on the product.

What is claimed is:

1. A method of reducing coal and dolomite, each having its own hardness characteristic, the coal and dolomite being simultaneously reduced in a common impact mill to prepare a common charge of a mix thereof having a particle size as a fuel for combustion, said method comrising the steps of:

(a) mixing the coal and dolomite initially in a predetermined volumetric ratio in the impact mill, thereby forming a common charge of coal and dolomite;

(b) impacting the common charge of coal and dolomite, thereby reducing the size of the coal and dolomite;

(c) retaining a portion of the common charge of coal and dolomite during the impacting step in the mill to absorb a portion of the impact energy applied to the coal and dolomite, thereby minimizing the formation of extreme fines; and (d) collecting the common charge of coal and dolomite after the impacting step.

2. The method set forth in claim 1 and including the step of supplying a larger volume of coal than that of dolomite to the mill.

3. The method set forth in claim 2 and further proportioning the ratio of coal and dolomite in a mix of two parts of coal for one part of dolomite.

4. The method set forth in claim 1 which includes the steps of stripping fines from the common charge of coal and dolomite in advance of the impacting in the mill; and retaining a portion of the common charge of coal and dolomite, thereby creating a soft bed to absorb the impact energy, thereby limiting reduction of the coal and dolomite to a size that is not less than 140 mesh.

5. A method of simultaneously grinding coal and dolomite, each having different hardness characteristics, in a common grinding mill having a grinding chamber and impact hammers on a grinding rotor, which method comprises the steps of:

(a) supplying coal and dolomite to the grinding chamber;

(b) enlarging the grinding chamber, thereby forming a clearance space in the grinding chamber to accumulate a cushion of coal and dolomite to minimize the presence of fines;

(c) supplying air into the grinding mill for conveying coal and dolomite reduced in the grinding mill;

(d) supplying a mixed charge of the coal and dolomite into the air in advance of the entry of the coal and dolomite into the grinding chamber, thereby preventing fines present in the mixed charge from entering the grinding chamber; and (e) subjecting the mixed charge of the coal and dolomite to a grinding action caused by rotating the hammers.

6. The method set forth in claim 5 and including the step of supplying a larger volume of coal than that of dolomite to the mill.

7. The method set forth in claim 6 and including the step of grinding the coal and dolomite to a predetermined particle size, thereby controlling sulphur dioxide emission upon burning of the coal and dolomite.

8. The method set forth in claim 5 and including the step of grinding the mixed charge of coal and dolomite to a condition which yields a mixed charge containing substantially more particle sizes of 6 mesh than particle sizes of minus 140 mesh at a density of approximately 109 pounds per cubic foot.

9. A method of simultaneously reducing coal and dolomite in a common impact mill having a material reduction chamber to prepare a mix of the coal and dolomite having a particle size reduction suitable as a fuel, said method comprising the steps of:

(a) delivering air to the material reduction chamber for drying the mix of the coal and dolomite and conveying the mix out of the reduction chamber;

(b) supplying a mix of the coal and dolomite to the material reduction chamber in opposition to the delivery of air, thereby allowing the air to sweep initially present material fines away from introduction to the reduction chamber;

(c) impacting the mix of coal and dolomite in the reduction chamber, thereby reducing the size of the coal and dolomite;

(d) retaining, in the reduction chamber, a portion of the coal and dolomite that is impacted in position to absorb a portion of the impact energy applied to the coal and dolomite;

(e) collecting the mix of coal and dolomite therefrom that is reduced and air conveyed out of the reduction chamber separately from the fines swept out of the reduction chamber; and (f) utilizing the heat from combustion of the fines to raise the temperature of the air delivered to the reduction chamber, thereby enhancing the drying of the mix of the coal and dolomite.

* * * * *